US006104262A

United States Patent [19]

Kich

[11] Patent Number: 6,104,262

[45] Date of Patent: Aug. 15, 2000

[54] RIDGED THICK WALLED CAPACITIVE SLOT

[75] Inventor: Rolf Kich, Redondo Beach, Calif.

[73] Assignee: Hughes Electronics Corporation, El Segundo, Calif.

[21] Appl. No.: 09/167,075

[22] Filed: Oct. 6, 1998

[51] Int. Cl.[7] ..... H01P 1/208

[52] U.S. Cl. ..... 333/212; 333/230

[58] Field of Search ..... 333/202, 208, 333/209, 210, 212, 227, 230, 231

[56] References Cited

U.S. PATENT DOCUMENTS

| | | | |
|---|---|---|---|
| 2,432,093 | 12/1947 | Fox | 333/212 X |
| 3,577,104 | 5/1971 | Levy | 333/212 |
| 4,680,561 | 7/1987 | Shirai | 333/208 |
| 4,725,797 | 2/1988 | Thompson et al. | 333/212 |
| 4,812,790 | 3/1989 | Tatomir et al. | 333/212 |
| 5,051,713 | 9/1991 | Yokota | 333/212 |
| 5,805,033 | 9/1998 | Liang et al. | 333/212 X |

FOREIGN PATENT DOCUMENTS

| | | | |
|---|---|---|---|
| 0045242A1 | 2/1982 | European Pat. Off. | 333/208 |

*Primary Examiner*—Robert Pascal
*Assistant Examiner*—Barbara Summons
*Attorney, Agent, or Firm*—Terje Gudmestad; M. W. Sales

[57] ABSTRACT

A capacitive coupler for a microwave circuit that has a first cavity and a second cavity separated by a wall. The separating wall has an aperture that, due to its shape, is capacitive. The aperture has a pair of elongated walls separated by a pair of side walls. The elongated walls and the side walls each have a thickness substantially thicker than what is now the industry standard. At least one of the elongated walls has a ridge. Because the distance between the first elongated wall and the second elongated wall is substantially greater than that previously known, the aperture may be easily manufactured.

16 Claims, 3 Drawing Sheets

RIDGED THICK WALLED CAPACITIVE SLOT

TECHNICAL FIELD

The present invention relates generally to a microwave filter and, more particularly, to a capacitive coupling for a microwave filter.

BACKGROUND ART

Microwave circuits are commonly used for many communications applications such as satellite communications. Microwave circuits are essentially wave guides that take the shape of a rectangular or cylindrical structure. Often, a plurality of waveguides are coupled together to form filter circuits. Communications satellites commonly use elliptic function filters.

To obtain sufficient performance, bridge couplings connecting non-sequential resonators are employed. The couplings for a bridge coupling often requires a capacitive (sign non-inverting) coupling rather than an inductive (sign inverting) coupling.

Capacitive bridge couplings are commonly formed from probes that are inserted into the coupling. The probes are typically supported with some form of low loss dielectric. Two problems are associated with probes. First, it is often difficult to fine tune the adjustment to remove the effects of variable tolerances. Second, for high frequencies above 20 GHz, such probes are difficult to implement.

Another type of capacitive coupling is an extremely narrow slit aperture. The width of the slits must be large enough so that the cut off frequency of the slit lies below the filter frequency. The iris resonance is the cut-off frequency of the slot. Because of this limitation, the slot height must remain extremely small. One problem with machining an extremely small slot is that the tolerance variation alone makes this type of slot uncontrollable and unpredictable in a manufacturing environment. With a thin slot, the fine tuning is difficult to implement.

SUMMARY OF THE INVENTION

It is, therefore, one object of the invention to provide a capacitive coupling that is easy to manufacture. It is a further object of the invention to provide a capacitive coupler that is capable of being fine tuned.

In one aspect of the invention, a capacitive coupling for coupling a first cavity and a second cavity of a microwave circuit has a wall separating the first cavity and the second cavity. The wall has an aperture formed therein. The aperture has a first elongated wall and a second elongated wall. The first wall is positioned opposite the second wall. The aperture further has a first side wall and a second side wall extending between the first elongated wall and the second elongated wall. The first elongated wall and the second elongated wall define the length of the aperture. The first side wall and the second side wall define the height of the aperture. The first side wall and the second side define the thickness of the aperture. The first elongated wall has a first ridge extending a predetermined distance therefrom to define a narrow channel having a height less than the height of the iris between the first elongated wall and the second elongated wall. The thickness of the first side wall and the second side wall is sized so that the aperture is capacitive.

In a further aspect of the invention, a second ridge extends from the second elongated wall. The first ridge and the second ridge define the narrow channel. One feature of the invention is that a tuning screw may be coupled within the aperture. Preferably, the tuning screw is located within the narrowed channel. The tuning screw allows the capacitance of the iris to be adjusted.

In another aspect of the invention, the thickness of the iris is greater than about 80 mils. More preferably, the thickness is between about 80 mils and about 120 mils.

A more complete understanding of the present invention can be determined from the following detailed description when taken in view of the attached drawings and the claims appended hereto.

BEST MODES FOR CARRYING OUT THE INVENTION

The present invention was described herein in terms of a capacitive iris for various microwave filters and circuits. However, it should be understood that the present invention is applicable to various other microwave filtering and coupling applications requiring a capacitive interface, as would be evident to those skilled in the art. For example, phased arrays or beam forming networks may use a large number of filters and some of their couplings may be capacitive.

Figure 1A:
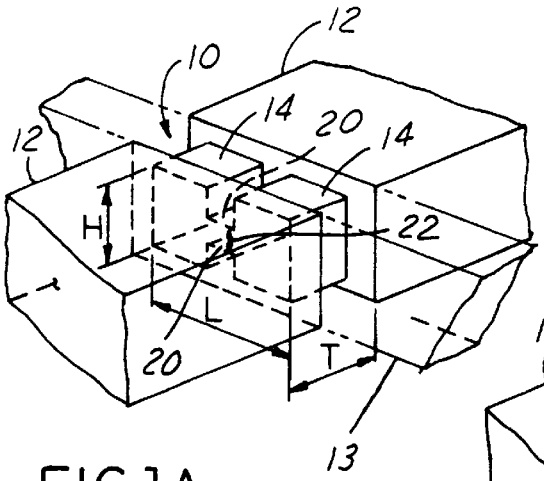
FIG. 1A is a perspective view of a capacitive iris having two opposed ridges in accordance with the present invention.
Figure 1B:
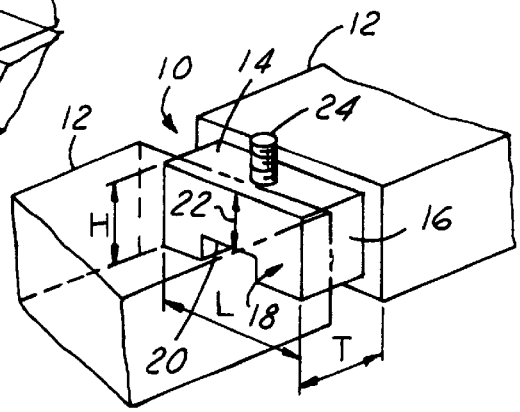
FIG. 1B is a perspective view of a capacitive iris having a single ridge.

Referring now to FIGS. 1A and 1B, a coupler 10 is depicted joining together two microwave cavities 12 through a separating wall 13. As shown in FIGS. 1A and 1B, the microwave cavities may have a rectangular cross-section. As will further be described below, the microwave cavities may have other cross-sections, such as cylindrical, or comprise a coaxial waveguide.

Coupler 10 generally has a pair of elongated walls 14. The elongated walls 14 define the longest dimension of coupler 10 and are preferably parallel to each other. The elongated walls 14 have a length L and are separated by a pair of side walls 16 that define a height H of the coupler 10. Preferably, side walls 16 are parallel to each other.

Elongated walls 14 and side walls 16 define an aperture 18 therebetween. Aperture 18 has a thickness T that corresponds to the thickness of the elongated walls 14 and the side walls 16.

Aperture 18 has two ridges 20 extending therein. The ridges 20 extend from elongated wall 14 and reduce the height H of aperture 18 in a predetermined area. As shown in FIG. 1A, a paired ridge is incorporated within aperture 18. In FIG. 1B, a single ridge 20 is incorporated within aperture 18. In either embodiment, the ridge 20 defines a narrowed portion 22 within aperture 18. The ridges 20 also extend the thickness T of coupler 10. Preferably, the ridges are centrally located on elongated wall 14. However, one skilled in the art would recognize that ridges 20 may be off center toward one of side walls 16.

Prior to the present invention, thickness T of known couplers was about 20 mils or less. In the present invention, to achieve a manufacturable capacitive aperture, the thickness T is about four times greater than known couplers (the "industry standard") or about 80 mils. Preferably, the thickness is between five or six times the industry standard thickness, or between about 100 to 120 mils. By increasing the thickness T, the height H can also be advantageously greater than that of the prior art. By having a greater height H, the aperture 18 is easier to manufacture than prior known capacitive slots. The presence of ridge 20 also allows height H to be increased. By having substantial dimensions H, L and T, aperture 18 may be easily manufactured and is less susceptible to small manufacturing tolerances of these dimensions.

Referring now to FIG. 1B, aperture 18 may have a tuning screw 24 incorporated therein. Tuning screw 24 is preferably located opposite ridge 20. Although tuning screw 24 is shown in a single ridge application, tuning screw 24 may also be incorporated into a dual ridge configuration such as that shown in FIG. 1A.

Tuning screw 24 is preferably formed of a material similar to that of coupler 10. Tuning screw 24 may be adjusted after the manufacture of the coupler 10 to tune the capacitance of aperture 18 to a desired value.

Figure 2:
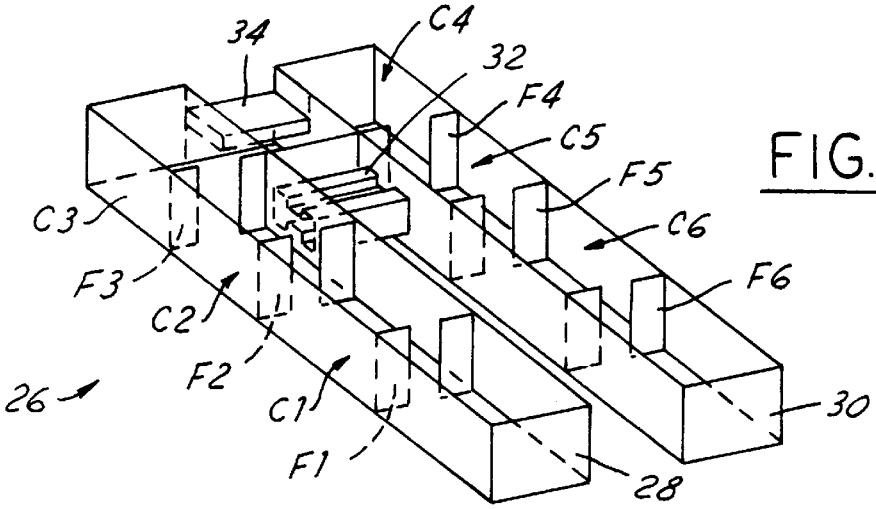
FIG. 2 is a perspective view of a six cavity filter having inductive portions and a capacitive portion formed according to the present invention.

Referring now to FIG. 2, an inductive iris filter 26 is illustrated having six cavities denoted by C1, C2, C3, C4, C5, and C6. Filter 26 has an input 28 and an output 30. A plurality of filter walls form filters F1 through F6. Filters F1 through F6 separate cavities C1 through C6. The second cavity and fifth cavity C5 are coupled by a capacitive coupler 32 formed in accordance with the present invention. An evanescent coupling 34 may be used to couple cavity C3 and cavity C4. Depending on the desired filter output, various configurations for filter 26 may be formed by changing the number of cavities, the location of capacitive coupler 32, and by changing the location or eliminating evanescent coupler 34. Filter 26 is a transverse electric mode filter, more specifically the filter is a $TE_{1,0}$ filter. Filter 26 is preferably folded back on itself in order to realize a canonical quasi-elliptic form.

Figure 3:
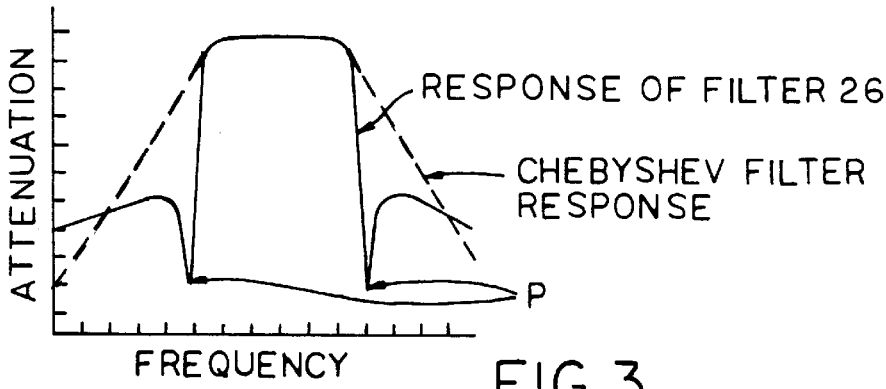
FIG. 3 is a plot of attenuation versus frequency for various filters.

Referring now to FIG. 3, the output of filter 26 of FIG. 2 is illustrated. Attenuation versus frequency is plotted for a Chebyshev filter shown in dash lines and the output of filter 26. As shown, by providing feedback between non-consecutive resonator cavities, the insertion loss poles P near the in-band are introduced. As illustrated, the response of filter 26 has a sharper, more desirable cut-off response than a Chebyshev filter.

Figure 4A:
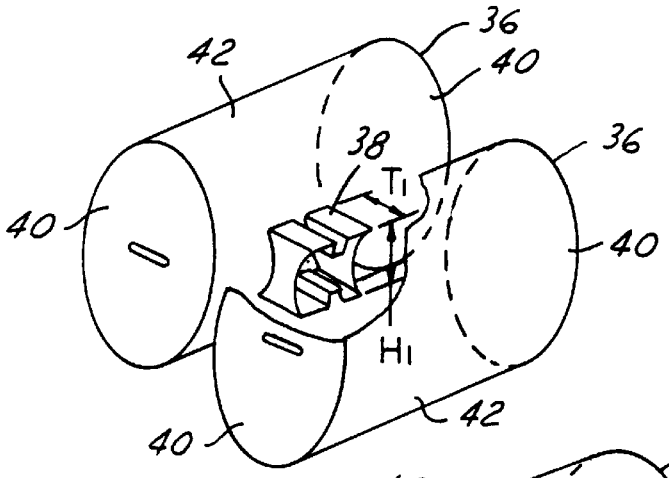
FIG. 4A depicts a cutaway perspective view of a capacitive aperture through the cylindrical walls of two adjacent cylindrical resonators.

Referring now to FIG. 4A, a pair of cylindrical resonant cavities 36 are illustrated. Cylindrical resonant cavities 36 have end walls 40 and cylindrical side walls 42. In order to incorporate coupler 38 into and between adjacent cylindrical walls 42, the coupler has a thickness $T_1$ that is not uniform throughout height $H_1$.

Figure 4B:
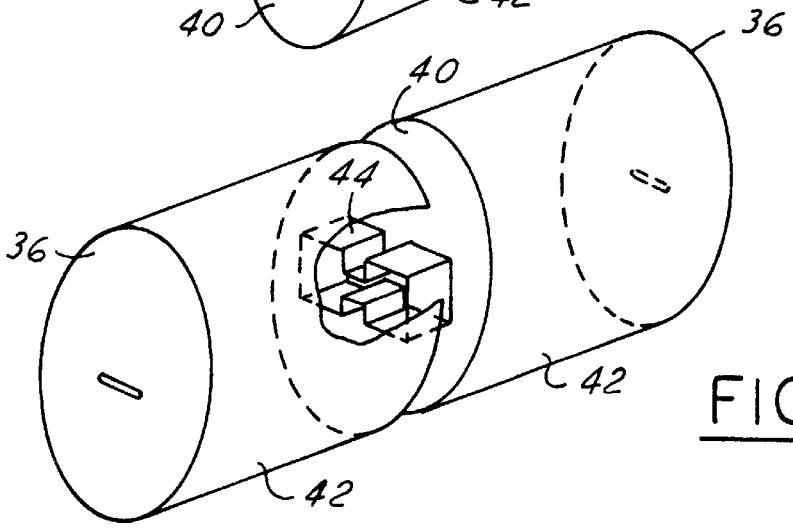
FIG. 4B depicts a capacitive aperture through end walls of a pair of axially adjacent cylindrical resonators.

Referring now to FIG. 4B, a coupler 44 is shown in end walls 40 of cylindrical resonant cavities 36. In the configuration of FIG. 4B, the dimensions of coupler 44 do not have to be changed from that of coupler 10 shown in FIGS. 1A and 1B.

Figure 5:
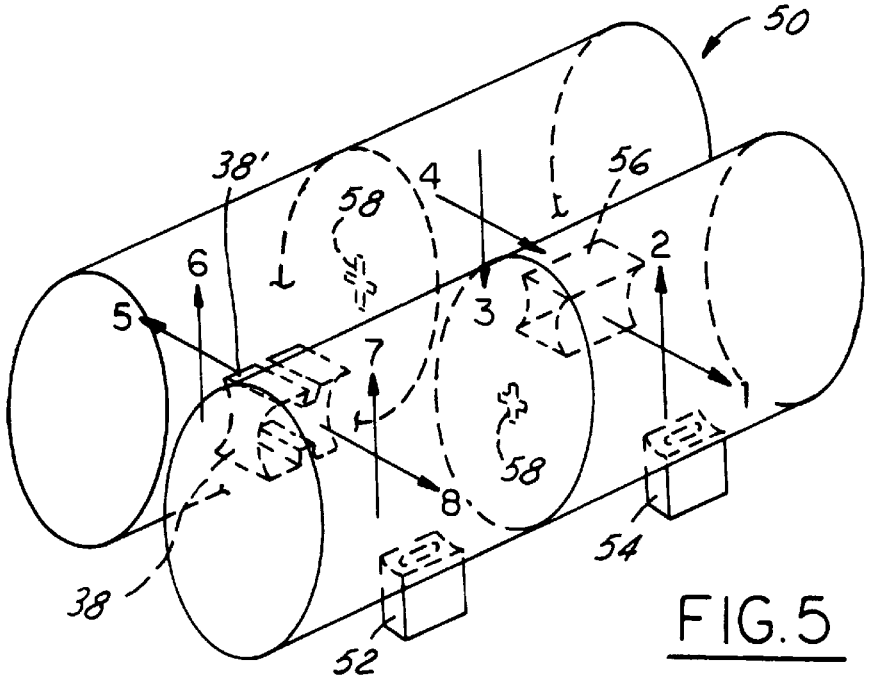
FIG. 5 is a perspective view of a four cavity cylindrical filter having a capacitive iris.

Referring now to FIG. 5, a canonical eight section cylindrical filter 50 is illustrated. Filter 50 has an input port 52 and an output port 54. A coupler 38' is provided which is similar to the coupler 38 shown in FIG. 4A and is positioned between two adjacent cylindrical walls. An inductive bridge 56 may also be used to couple adjacent filter cavities together as is common in the art. Further, conventional inductive irises 58 may also be used to link adjacent filter cavities. Reference numerals 1 through 8 represent the various stages of the signal as it moves through the 8 stages of filter 50.

Figure 6:
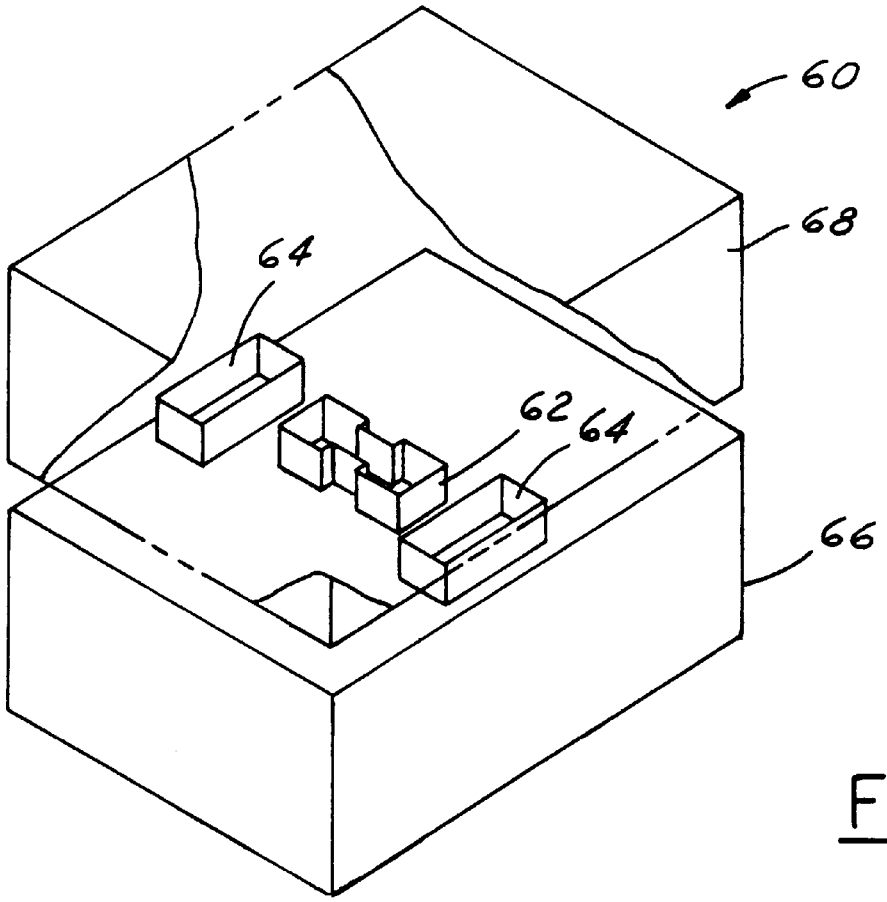
FIG. 6 is a perspective view of a waveguide coupler having a capacitive iris in accordance with the present invention.

Referring now to FIG. 6, a waveguide coupler 60 is shown having a capacitive coupler 62 formed according to the present invention, as well as a pair of secondary couplers 64. Waveguide coupler 60 has a main waveguide 66 and a second waveguide 68 coupled to it by capacitive coupler 62.

While particular embodiments of the invention have been shown and described, numerous variations and alternate embodiments will occur to those skilled in the art. Accordingly, it is intended that the invention be limited only in terms of the appended claims.

What is claimed is:

1. A capacitive coupler for a microwave circuit having a first cavity and a second cavity, each of said cavities sustaining electromagnetic waves, said circuit comprising:

a separating wall separating said first cavity and the second cavity;

said separating wall having an aperture formed therein, said aperture having a first elongated wall and a second elongated wall defining an aperture length, said first elongated wall positioned opposite said second elongated wall and, a first side wall and a second side wall extending between said first elongated wall and said second elongated wall, said first side wall and said second side wall defining an aperture height, said first side wall, said second side wall, said first elongated wall and said second elongated wall defining an aperture thickness;

said first elongated wall having a first ridge extending a predetermined distance therefrom, to define a narrowed portion having a height less than the height of said aperture between said first elongated wall and said second elongated wall;

said length, height and thickness sized to define a capacitance of said aperture.

2. A capacitive coupler as recited in claim 1 further comprising a second ridge extending from said second elongated wall.

3. A capacitive coupler as recited in claim 1 wherein said second ridge is directly opposite said first ridge, said first ridge and said second ridge defining said narrowed channel.

4. A capacitive coupler as recited in claim 1 further comprising a tuning screw, said tuning screw extending into said aperture.

5. A capacitive coupler as recited in claim 1 wherein said tuning screw is positioned opposite said ridge.

6. A capacitive coupler as recited in claim 1 wherein said first elongated wall is generally parallel to said second elongated wall.

7. A microwave circuit comprising:

a first cavity;

a second cavity;

a separating wall separating said first cavity and the second cavity;

said separating wall having an aperture formed therein, said aperture having a first elongated wall and a second elongated wall defining an aperture length, said first elongated wall positioned opposite said second elongated wall and, a first side wall and a second side wall extending between said first elongated wall and said second elongated wall, said first side wall and said second side wall defining an aperture height, said first side wall, said second side wall, said first elongated wall and said second elongated wall defining an aperture thickness;

said first elongated wall having a first ridge extending a predetermined distance therefrom, to define a narrowed portion having a height less than the height of said aperture between said first elongated wall and said second elongated wall;

said length, height and thickness are sized so that said aperture is capacitive;

said thickness being greater than about 80 mils.

8. A microwave circuit as recited in claim 7 wherein said thickness is about between about 80 to about 120 mils.

9. A microwave circuit as recited in claim 7 further comprising a second ridge extending from said second elongated wall.

10. A microwave circuit as recited in claim 7 wherein said second ridge is directly opposite said first ridge, said first ridge and said second ridge defining said narrowed channel.

11. A microwave circuit as recited in claim 7 further comprising a tuning screw, said tuning screw extending into said aperture.

12. A microwave circuit as recited in claim 7 wherein said tuning screw is positioned opposite said ridge.

13. A microwave circuit as recited in claim 7 wherein said first elongated wall is generally parallel to said second elongated wall.

14. A microwave circuit as recited in claim 7 wherein a resonance of said aperture is less than said filter frequency.

15. A microwave circuit as recited in claim 7 wherein said first and second cavities are cylindrical.

16. A microwave circuit as recited in claim 7 wherein said first and second cavities are rectangular.

* * * * *